US008578626B2

(12) United States Patent
Steffens

(10) Patent No.: US 8,578,626 B2
(45) Date of Patent: Nov. 12, 2013

(54) LAUNDRY DRYER HAVING A DISTRIBUTOR FOR CONDENSATE, AND A METHOD OF OPERATING THE SAME

(75) Inventor: Günter Steffens, Dallgow-Döberitz (DE)

(73) Assignee: BSH Bosch und Siemens Hausgeraete GmbH, Munich (DE)

( * ) Notice: Subject to any disclaimer, the term of this patent is extended or adjusted under 35 U.S.C. 154(b) by 719 days.

(21) Appl. No.: 12/677,122

(22) PCT Filed: Sep. 8, 2008

(86) PCT No.: PCT/EP2008/061859

§ 371 (c)(1),
(2), (4) Date: Mar. 9, 2010

(87) PCT Pub. No.: WO2009/040237

PCT Pub. Date: Apr. 2, 2009

(65) Prior Publication Data

US 2010/0199515 A1 Aug. 12, 2010

(30) Foreign Application Priority Data

Sep. 20, 2007 (DE) ..... 10 2007 044 881
Oct. 31, 2007 (DE) ..... 10 2007 052 075

(51) Int. Cl.
*F26B 3/02* (2006.01)

(52) U.S. Cl.
USPC ..... 34/468; 34/597; 34/602; 34/218; 8/149.3; 68/18 R; 134/198

(58) Field of Classification Search
USPC ..... 34/468, 597, 602, 606, 74, 218; 8/149.2, 149.3; 68/5 C, 5 R, 18 R, 22; 134/184, 198
See application file for complete search history.

(56) References Cited

U.S. PATENT DOCUMENTS 3,009,257 A * 11/1961 Scott ..... 34/71
3,899,108 A * 8/1975 Frauendorf ..... 223/51
4,519,145 A * 5/1985 Mandel ..... 34/389
4,866,859 A * 9/1989 Kopelman ..... 34/526

(Continued)

FOREIGN PATENT DOCUMENTS

DE 3000865 A1 7/1981
DE 19737075 A1 3/1998

(Continued)

OTHER PUBLICATIONS

Nebulizer non-patent literature search using www.google.com dated May 2013.*

*Primary Examiner* — Steve M Gravini
(74) *Attorney, Agent, or Firm* — James E. Howard; Andre Pallapies

(57) ABSTRACT

A laundry dryer includes a drying chamber, a process air channel having a supply air opening for drawing in process air, an exhaust air opening for expelling process air, an exhaust air channel through which process air is conducted to the exhaust air opening, and a nebulizer that distributes condensate in process air. The dryer further includes a fan in the process air channel for driving process air through the drying chamber, and a heat exchanger that extracts heat from process air flowing out from the drying chamber, supplies heat to process air flowing into the drying chamber, and separates the condensate from the process air for the nebulizer.

21 Claims, 3 Drawing Sheets

(56) References Cited

U.S. PATENT DOCUMENTS

| | | | | |
|---|---|---|---|---|
| 5,419,469 | A * | 5/1995 | Urso | 223/70 |
| 5,459,945 | A * | 10/1995 | Shulenberger | 34/605 |
| 6,094,835 | A * | 8/2000 | Cromer | 34/80 |
| 7,059,065 | B2 * | 6/2006 | Gerlach et al. | 34/381 |
| 7,367,137 | B2 * | 5/2008 | Jonsson et al. | 34/265 |
| 7,392,600 | B2 * | 7/2008 | Gerlach et al. | 34/381 |
| 7,921,578 | B2 * | 4/2011 | McAllister et al. | 34/597 |
| 2005/0050644 | A1 * | 3/2005 | Severns et al. | 8/115.51 |
| 2006/0101666 | A1 * | 5/2006 | Cho et al. | 34/596 |
| 2006/0179676 | A1 * | 8/2006 | Goldberg et al. | 34/77 |
| 2007/0006484 | A1 | 1/2007 | Moschuetz et al. | |
| 2007/0151129 | A1 * | 7/2007 | McAllister et al. | 38/3 |
| 2008/0245362 | A1 * | 10/2008 | Moessis et al. | 128/200.16 |
| 2008/0283626 | A1 * | 11/2008 | Aldana et al. | 239/68 |
| 2009/0113740 | A1 * | 5/2009 | Grunert et al. | 34/86 |
| 2010/0154248 | A1 * | 6/2010 | Stolze | 34/493 |
| 2010/0275457 | A1 * | 11/2010 | Balerdi Azpilicueta et al. | 34/86 |
| 2011/0000099 | A1 * | 1/2011 | Steffens | 34/493 |
| 2011/0209484 | A1 * | 9/2011 | Krausch et al. | 62/79 |
| 2012/0198718 | A1 * | 8/2012 | Odueyungbo | 34/60 |

FOREIGN PATENT DOCUMENTS

| | | | | |
|---|---|---|---|---|
| DE | 4023000 | C2 | 2/2003 | |
| DE | 102005062616 | A1 | 6/2007 | |
| DE | 102007011809 | A1 | 9/2008 | |
| EP | 467188 | A1 * | 1/1992 | D06F 58/20 |
| EP | 1591579 | A1 | 11/2005 | |
| WO | 2004046448 | A1 | 6/2004 | |
| WO | 2008013382 | A2 | 1/2008 | |

* cited by examiner

LAUNDRY DRYER HAVING A DISTRIBUTOR FOR CONDENSATE, AND A METHOD OF OPERATING THE SAME

BACKGROUND OF THE INVENTION

The invention relates to a laundry dryer having a drying chamber for the articles to be dried and having a process air channel, in which are located a fan for driving process air through the drying chamber and a heat exchanger arrangement, which can extract heat from the process air flowing out from the drying chamber and can supply heat to the process air flowing into the drying chamber, the process air channel having a supply air opening for drawing in process air from the surroundings of the laundry dryer, an exhaust air opening for expelling process air to the surroundings of the laundry dryer and an exhaust air channel part, through which process air can be conducted to the exhaust air opening and which has a distributor, by way of which condensate, which has been separated off from the process air in the heat exchanger arrangement, can be distributed in the process air flowing through.

The invention also relates to a method for operating such a laundry dryer.

Such a laundry dryer and such a method appear in the non-prepublished German patent application 10 2007 011 809.2 and the similarly non-prepublished international patent application PCT/EP2008/052259 parallel thereto. In the laundry dryer described there the heat exchanger arrangement can be a simple heat exchanger or heat pump.

A laundry dryer with heat recovery appears in DE 30 00 865 A1. This describes what is known as an exhaust air dryer, which heats an air flow in an open channel once and passes it through the laundry to be dried, then expels it from the channel. The heat recovery takes place by means of a simple heat exchanger, in which heat from the process air to be expelled is transferred to newly inflowing process air. The process air heated in the heat exchanger is heated further by means of a heater and then reaches the laundry items to be dried.

A laundry dryer appears in WO 2004/059070 A1 having an atomizer, in particular an ultrasonic nebulizer, which can be used to distribute a fluid in the process air supplied to the articles to be dried or treated.

Generally a laundry dryer is operated in the manner of an exhaust air dryer or a condensation dryer. An exhaust air dryer conducts heated air once through the laundry to be dried and discharges this moisture-laden air through an exhaust air hose from the exhaust air dryer and out of the room in which it is located. A condensation dryer, the mode of operation of which is based on the condensing of the moisture evaporated from the laundry by means of warm process air, does not require an exhaust air hose and allows energy to be recovered from the heated process air, for example by using a heat pump. However with such a condensation dryer it is generally necessary to collect the condensate occurring and either pump it away or dispose of it by emptying collecting vessels manually.

A laundry dryer with a heat pump circuit is described in DE 40 23 000 C2, being configured essentially as a condensation dryer and wherein a supply air opening is arranged in the process air channel between a condenser and an evaporator in the heat pump circuit, it being possible to close off said supply air opening with a controlled sealing facility.

With an exhaust air dryer the air, which is moisture laden after passing through the drum containing the laundry items, is generally conducted from the dryer. Compared with a condensation dryer an exhaust air dryer is simpler and therefore cheaper to construct. During operation an exhaust air dryer draws air from its surroundings and uses it directly for drying purposes.

As described in DE 30 00 865 A1, heat recovery is also possible in principle in an exhaust air dryer but such heat recovery involves a certain cooling of the air, in which process condensate can be precipitated from the exhaust air and would have to be disposed of. Ambient air (at for example 20° C. and 60% relative air humidity; known as supply air) flows over heat exchanger surfaces of the air/air heat exchanger and is heated there as the warm process air coming from the drying chamber is cooled. Depending on the cooling output or heat exchange, condensate occurs which is collected in a vessel or pumped away. In the first instance emptying is necessary and in the second instance a connection to the waste water network. The amount of condensate occurring is a measure of the thermal energy emitted in the heat exchanger and therefore a measure of the energy efficiency improvement.

To dispose of condensate occurring during a drying process and without the need for interim storage and otherwise disposing of the condensate, according to the non-prepublished patent application cited above provision is made for conducting some of the process air to be discharged from the dryer past the heat exchanger arrangement and by way of an evaporator, to which evaporator the condensate occurring is supplied, so that it evaporates in the process air flowing over it and can be discharged with this. However this necessarily means that some of the heat present in the air to be discharged is no longer available to be recirculated to the drying process.

BRIEF SUMMARY OF THE INVENTION

The object of the present invention is therefore to provide a dryer of the type mentioned in the introduction, with which it is not necessary to use the heat of some of the process air to be discharged to discharge occurring condensate. A corresponding generic method is also to be provided.

Preferred embodiments of the inventive laundry dryer and inventive method are set out in the dependent claims. Generally preferred embodiments of the inventive method correspond to preferred embodiments of the inventive laundry dryer and vice versa, even if specific reference is not made to this below.

The subject matter of the invention is therefore a laundry dryer having a drying chamber for the articles to be dried and having a process air channel, in which are located a fan for driving process air through the drying chamber and a heat exchanger arrangement, which can extract heat from the process air flowing out from the drying chamber and can supply heat to the process air flowing into the drying chamber, the process air channel having a supply air opening for drawing in process air from the surroundings of the laundry dryer, an exhaust air opening for expelling process air to the surroundings of the laundry dryer and an exhaust air channel part, through which process air can be conducted to the exhaust air opening and which has a distributor, by way of which condensate, which has been separated off from the process air in the heat exchanger arrangement, can be distributed in the process air flowing through, the distributor being a nebulizer.

The condensate separated off in this laundry dryer during drying is a measure of the recirculation of thermal energy to the drying process. Based on the energy balance sheet of an exhaust air dryer without heat recirculation, heat recirculation can in particular be dimensioned such and adjusted by corresponding design of the laundry dryer such that a predetermined improvement in the energy balance sheet is achieved, for example an improvement on the basis of which the laundry dryer could be classified in a desired, more efficient energy consumption class according to the standard system used in the European Union than the exhaust air dryer used as a basis. In this context there is no need to strive to separate off a maximum of moisture in the heat exchanger arrangement. To improve an energy consumption class C for the simple exhaust air dryer to B for the exhaust air dryer with heat recovery, it may be sufficient to strive to separate off no more than 10 grams of condensate per minute. The problem of storing a larger amount of condensate as in the condensation dryer then does not arise. It would also be conceivable to allow a fan arranged behind the heat exchanger arrangement in the laundry dryer to continue to run after the end of a drying process to create an air flow to distribute any remaining condensate. A small separate fan for this application would also be conceivable. Finally, depending on the design of the laundry dryer, a draft of air can also be used to distribute any remaining condensate, occurring for example due to a flue effect in the unused dryer. This distribution can but does not necessarily have to be assisted by the nebulizer. During operation the drying chamber in particular has to be closed off from the surroundings of the laundry dryer to allow an undisturbed flow of process air as required. To this end the drying chamber is closed off by means of a corresponding door. Apart from such use this door generally stands open, thereby also opening the process air channel to the surroundings of the laundry dryer. A draft of air resulting through the process air channel including the secondary channel and the open door can assist the distribution of remaining condensate in an effective manner.

In one preferred embodiment of the inventive laundry dryer the nebulizer is an ultrasonic nebulizer. Ultrasonic nebulizers in the form of compact, integrated and effective components are known and available and can be integrated in a laundry dryer without requiring much space. They are used in a variety of applications, for example in air humidifiers and inhalation devices.

Even given that the invention in principle does not make an particular demands on the manner and embodiment of the heat exchanger arrangement, a particularly preferred development of the invention is characterized in that the heat exchanger arrangement has a heat sink and a heat source of a heat pump circuit, in other words the laundry dryer according to this development uses a heat pump circuit to supply and discharge heat to and from the process air flow. Any heat pump can be used here in principle. One advantage of the heat pump is that temperature levels for cooling or heating the process air can be selected with a certain level of independence from one another. By adjusting the pump factor of the heat pump, in other words the relationship between the pumped thermal output and the output required for this, it is also possible to bring about any additional heating of the process air required; the unavoidable fact of the limited efficiency of a heat pump can thus be used as a further advantage.

The heat exchanger arrangement in the inventive laundry dryer preferably has an evaporator and a condenser of a heat pump circuit known per se, with such a heat pump circuit being designed according to the principle of the compressor heat pump. Such a heat pump circuit comprises an inherently closed line system for a cooling agent that can be circulated therein, in which line system are arranged the heat sink as the evaporator for the cooling agent, a compressor for compressing the evaporated cooling agent, the heat source as the condenser for the compressed cooling agent and a throttle valve for decompressing the condensed cooling agent. According to known practice the cooling agent used can in particular be fluorinated ethane derivatives as well as propane and carbon dioxide. With a laundry dryer equipped with such a heat pump the cooling of the warm, moisture-laden process air essentially takes place in the evaporator of the heat pump, where the transferred heat is used to evaporate the cooling agent. The cooling agent evaporated due to heating process is fed by way of the compressor to the condenser, where condensation of the gaseous cooling agent causes heat to be released, which is used to heat the process air. The cooling agent circulates in a closed circuit in which it returns to the evaporator from the condenser by way of a throttle valve.

Also preferred is an embodiment of the laundry dryer in which the exhaust air channel part is set up to store condensate. It is assumed here that the capacity of the process air flowing through the exhaust air channel during operation of the laundry dryer to absorb additional moisture is not always the same. At the start of the drying process, when the articles to be dried first have to heat up, the process air flow in the drying chamber absorbs little moisture and can therefore absorb and remove condensate left from a previous drying process. In the middle of the drying process the process air flow removes a relatively large amount of moisture from the articles to be dried and can therefore not absorb much condensate; it is therefore advantageous if condensate that cannot be distributed immediately can remain stored initially. Toward the end of a drying process, when the articles to be dried have surrendered a relatively large amount of moisture, the process air flow becomes drier again and at the same time warmer and can therefore absorb and eliminate more condensate. If not all the occurring condensate can be distributed in the process, a certain amount can remain stored until a subsequent drying process or be distributed separately, as described above.

The exhaust air channel part preferably also has a collecting vessel to collect the condensate. This collecting vessel can preferably also simply be a depression in the exhaust air channel part. Corresponding to this depression the exhaust air channel part can also preferably have at least one wall region angled toward the depression, which in particular can be embodied as a groove or line.

Particularly preferred is a development of the laundry dryer, in which the collecting vessel is arranged below the heat exchanger arrangement so that condensate occurring can drip directly into it. The collecting vessel can also preferably be embodied as a type of bypass of the exhaust air channel part to conduct some of the process air flow for absorbing condensate, which is also nebulized by the nebulizer, specifically through the collecting vessel. To this end the collecting vessel has a first opening, on the incoming side in respect of the process air flow, to the exhaust air channel part and a second opening, on the outgoing side in respect of the process air flow, to the exhaust air channel part and bridges the heat exchanger arrangement, in particular the heat sink, at least partially in the exhaust air channel part.

It is likewise preferable for a fill level sensor to be associated with the collecting vessel in the laundry dryer according to the invention. The collecting vessel here can be embodied such that it can be removed from the laundry dryer for the purposes of cleaning or otherwise disposing of the condensate.

Particularly preferred is an embodiment of the laundry dryer, in which the process air channel is an open channel leading from the supply air opening to the exhaust air opening. The inventive laundry dryer, in which an at least partial circulation of the process air would not be excluded in principle, is thus realized in the manner of an exhaust air dryer.

Similarly preferred is an embodiment of the laundry dryer, in which the process air channel has a heater. This heater may only be provided, depending on the magnitude of the pump output of the heat pump circuit, to heat the corresponding components of the laundry dryer and the damp articles introduced into the drum at the start of a drying process, with the drying process continuing without the use of the heater after heating has taken place. It is also possible to design the heat pump circuit with only a relatively low pump output and to introduce the heat required anyway for the drying process largely by way of the continuously operating heater. In each instance the heater offers further significant flexibility with regard to the design of the inventive laundry dryer and in particular the option of optimizing the laundry dryer in a variety of economical aspects.

The heater can in particular be an electrical heating element or an oil burner or gas burner according to conventional practice.

The subject matter of the invention is also a method for operating a laundry dryer having a drying chamber for the articles to be dried and having a process air channel, in which are located a fan for driving process air through the drying chamber and a heat exchanger arrangement, which extracts heat from the process air flowing out from the drying chamber and supplies heat to the process air flowing into the drying chamber, the process air channel having a supply air opening for drawing in process air from the surroundings of the laundry dryer, an exhaust air opening for expelling process air to the surroundings of the laundry dryer and an exhaust air channel part, through which process air is conducted to the exhaust air opening and in which a distributor distributes condensate, which has been separated off from the process air in the heat exchanger arrangement, in the process air flowing through, with distribution of the condensate taking place by nebulization.

In preferred embodiments of the method nebulization takes place due to the action of ultrasound or heat is drawn from the process air flowing out of the drying chamber and heat is supplied to the process air flowing into the drying chamber by means of a heat pump process operating in the heat exchanger arrangement. Explanations relating hereto will emerge from the corresponding details above, to which reference is hereby made.

BRIEF DESCRIPTION OF THE DRAWINGS

Further details of the invention will emerge from the description which follows of preferred but not restrictive exemplary embodiments of the laundry dryer and the method that can be used to operate said laundry dryer. Specifically.

DETAILED DESCRIPTION OF EXEMPLARY EMBODIMENTS OF THE PRESENT INVENTION

Figure 1:
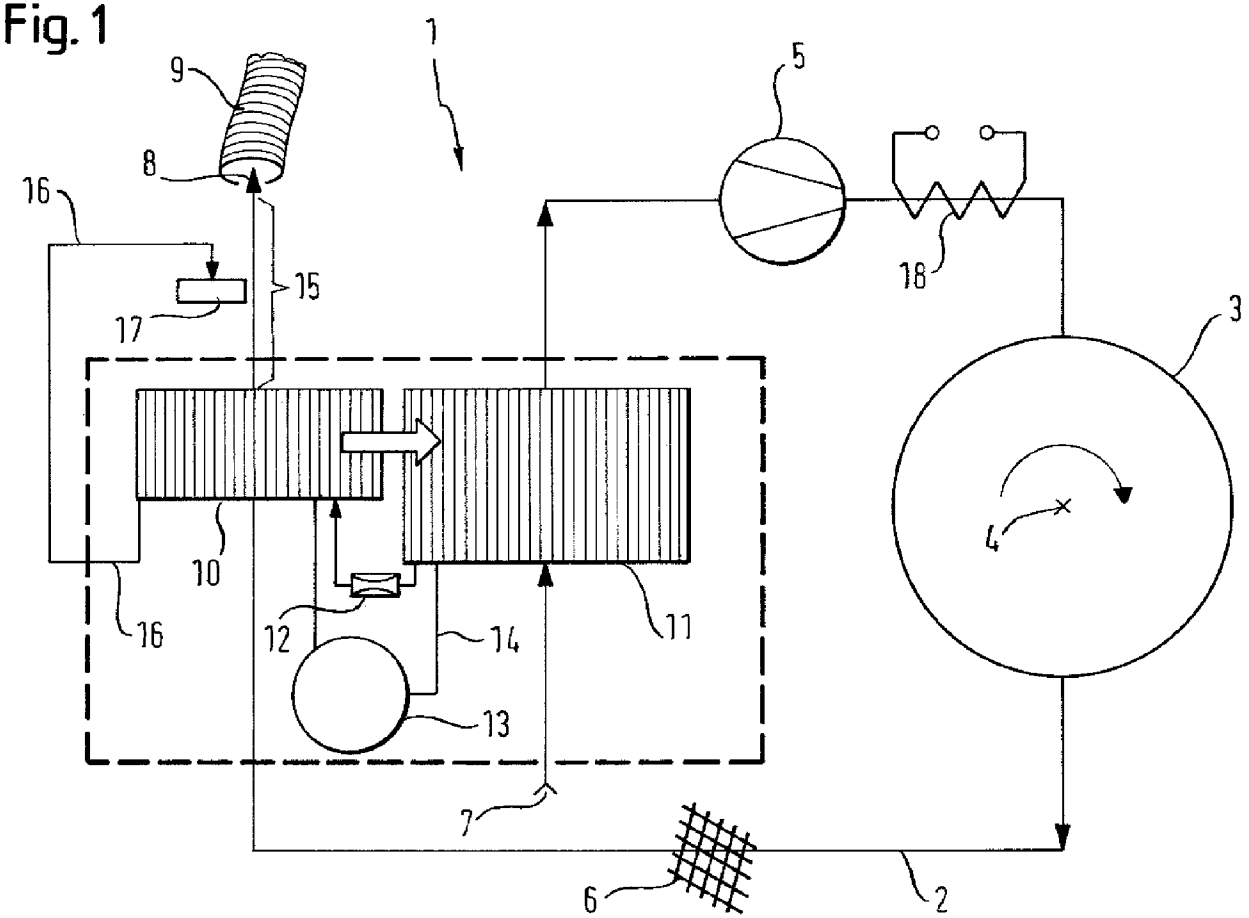
FIG. 1 shows an outline of an exemplary embodiment of a laundry dryer with a distributor for condensate.

The laundry dryer 1 shown as an outline in FIG. 1 has a process air channel 2 and a drying chamber 3, which is a drum 3 that can be rotated about an axis 4 shown as a small cross. Process air flowing in the process air flow is conducted by means of a fan 5 through the drum 3 and laundry items (not shown) located within it; behind the drum 3 the process air passes through a lint filter 6, which in the simplest instance is a screen-type filter 6 to catch lint, i.e. small threads that the process air extracts from the laundry items as they move against one another due to the rotation of the drum 3 and carries with it. This is important for the sufficiently long, breakdown-free functioning of the successive components of the laundry dryer 1 in the process air flow 2, as it prevents lint being deposited on said components. The process air is drawn into the process air channel 2 through a supply air opening 7 and expelled through an exhaust air opening 8. Air arrives at the supply air opening 7 directly from the surroundings of the laundry dryer 1. Connected to the exhaust air opening 8 is an exhaust air hose 9, which discharges the exhaust air from the laundry dryer 1 and from a building in which it is located. To this extent the laundry dryer 1 corresponds in structure and function to a conventional exhaust air dryer.

A heat exchanger arrangement 10, 11 is also present; the process air drawn in through the supply air opening 7 is heated in this or in its associated heat source 11. The heated process air is directed into the drum 3, comes into contact with the laundry to be dried there and then flows to the lint filter 6. The moist, warm process air, from which any lint has been removed, is then cooled in the heat sink 10. The heat thereby drawn from the process air is conducted in a heat pump circuit 10 to 14, components of which include the heat sink 10 and the heat source 11, from the heat sink 10 to the heat source 11, where it is fed to the newly inflowing process air. The fact that according to the laws of thermodynamics more heat goes into the process air than is drawn out of it in the heat sink 10 does not have any adverse effect on the heat pump process—some of the heat supplied is needed to evaporate moisture from the laundry items in the drum 3 and can therefore not be recovered anyway. Condensate is also precipitated from the cooling process air at the heat sink 10. This condensate has to be removed from the laundry dryer 1, as described in detail below.

The heat pump circuit 10 to 14 is formed by an evaporator 10, which functions as a heat sink 10, and the condenser 11, which functions as the heat source 11, as well as a throttle valve 12 and a compressor 13, all of which are connected to one another by way of a closed line system 14 to form a circuit. A cooling agent, which has to be cyclically evaporated, compressed, condensed and decompressed, is driven by the compressor 13 to circulate in the circuit. This cooling agent is a fluorinated ethane derivative, for example the compound known professionally as R134a, propane or carbon dioxide. Cooling agent leaving the evaporator 10 in gaseous form is compressed and heated by the compressor 13; it reaches the condenser 11, where it condenses, emitting heat to the process air. It then flows into the line system 14 through the throttle valve 12, where it is decompressed to a lower pressure, and reaches the evaporator 10, where it absorbs heat from the process air and evaporates. From the evaporator it flows in the line system 14 back to the compressor 13, closing the circuit. The heat pump 10 to 14 allows relatively free adjustment of the temperature levels in the evaporator 10 and in the condenser 11, the adjustment including the selection of the cooling agent and the pressure levels in the evaporator 10 and condenser 11. Therefore it also offers options for optimizing the energy balance sheet of the laundry dryer 1.

Figure 2:
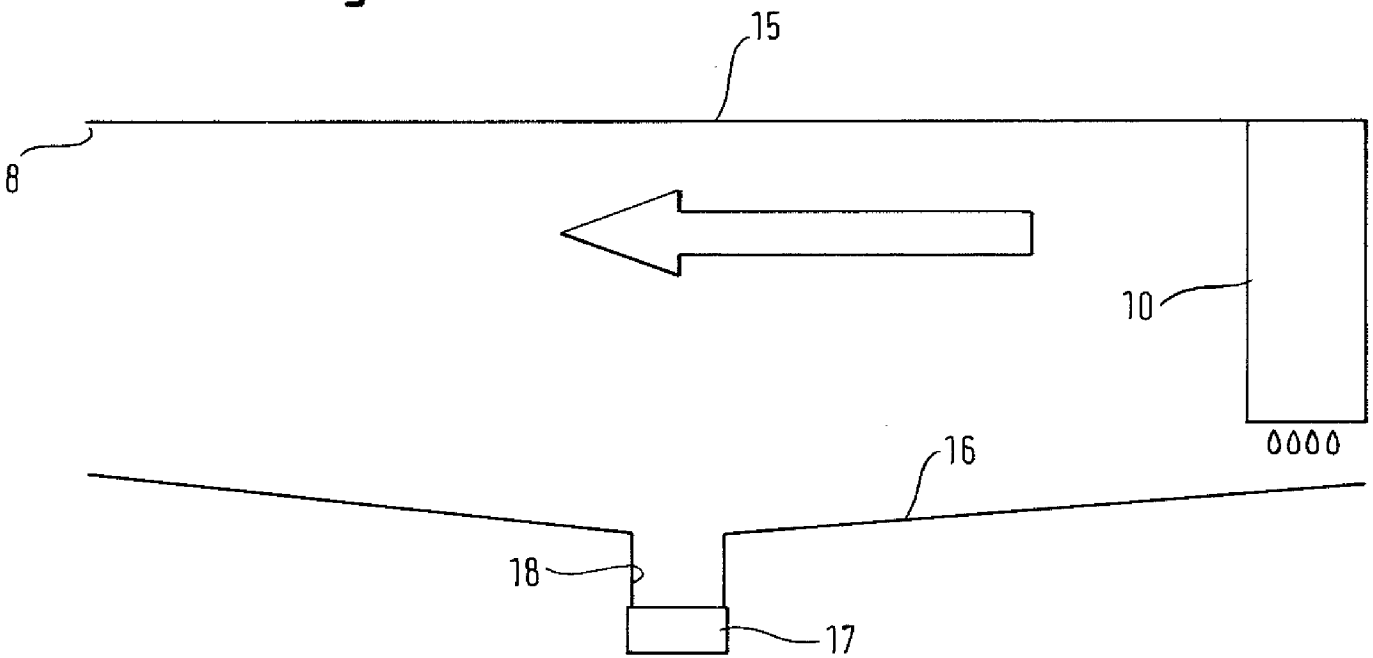
FIG. 2 shows an outline of a first embodiment of the exhaust air channel part of such a laundry dryer with the distributor for condensate.
Figure 3:
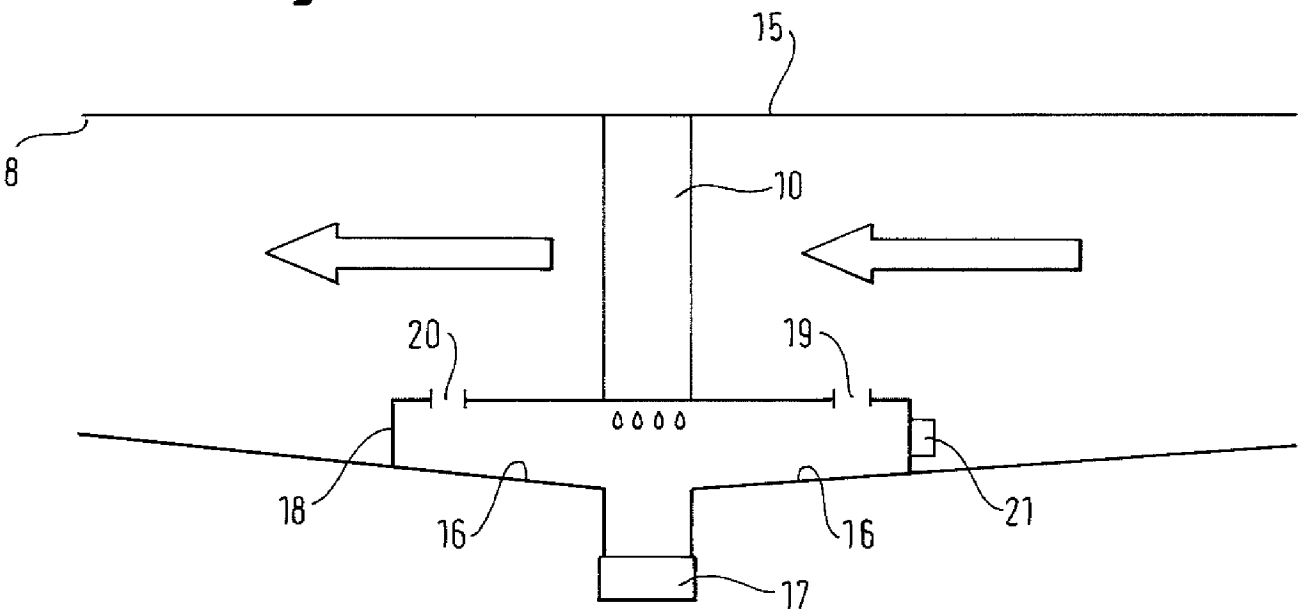
FIG. 3 shows an outline of a second embodiment of the exhaust air channel part.

To remove the condensate occurring in the evaporator 10, use is made of the process air flow, in which the condensate is distributed in an exhaust air channel part 15 of the process air channel 2 directly before the exhaust air opening 8—see also FIGS. 2 and 3 and the associated description. Condensate which occurs at the evaporator 10 passes through a corresponding line or groove or a correspondingly angled wall region 16 to a distributor 17, which is an ultrasonic nebulizer 17. A natural slope, which can be formed by corresponding construction of the exhaust air channel part 15, is expediently used to transport the condensate. In the exhaust air channel part 15 the process air flow absorbs nebulized condensate and discharges it through the exhaust air opening 8 and the exhaust air hose 9. Means for actuating the nebulizer 17 are not shown, nor are means for actuating other components of the laundry dryer 1. Such means are known in principle and there is therefore no need to examine them in more detail here.

One particular advantage of the nebulizer 17 is that it can be used to distribute the condensate in the process air without the process air satisfying specific thermodynamic requirements, in particular having to have a certain raised temperature and a certain reduced relative humidity in order to be able to condense condensate present as a fluid and thus absorb it. The condensate is conveyed away as a mist, in other words as a dispersion of fluid in gas. The limited life of a mist is of little significance—it is totally adequate for the mist essentially to last until it has left the laundry dryer 1 and passed through the exhaust air hose 9 from the surroundings of the laundry dryer 1.

The heater 18 shown in FIG. 1 between the fan 5 and the drum 3, in the present instance an electrical heating element 18, may only be provided, depending on the magnitude of the pump output of the heat pump circuit 10 to 14, to heat the corresponding components of the laundry dryer 1 and the damp articles introduced into the drum 3 at the start of a drying process, with the drying process continuing without the use of the heater 18 after heating has taken place; it is also possible to design the heat pump circuit 10 to 14 with only a relatively low pump output and to introduce the heat required for the drying process to a great or lesser extent by way of the continuously operating heater 18. The specific design of the laundry dryer 1 between these extremes is a matter for consideration, which also takes into account economic aspects—the heat pump circuit 10 to 14 is an important cost factor for the laundry dryer 1, the price of which is lower, the smaller the heat pump circuit 10 to 14. Ultimately a compromise has to be found between a still acceptable price and a still acceptable degree of heat recovery in the laundry dryer 1.

FIG. 2 shows a simple exemplary embodiment of the exhaust air channel part 15. Condensate which drips from the heat sink 10 reaches the collecting vessel 18 by way of the slope defined by the angled wall region 16, said collecting vessel 18 simply being a depression 18, which contains the ultrasonic nebulizer 17. The condensate nebulized by the ultrasonic nebulizer 17 arrives at the process air flow symbolized by a thick arrow, after said process air flow has flowed through the heat sink 10, and is discharged from the exhaust air channel part 15 by this.

According to FIG. 3 a separate collecting vessel 18 that can optionally be removed for the purposes of cleaning or otherwise disposing of any remaining condensate is provided in the exhaust air channel part 15. The collecting vessel forms a bypass, through which some of the process air flow is conducted past the heat sink 10. Said process air enters the collecting vessel 18 at the first opening on the incoming side of the heat sink 10 (in respect of the process air flow symbolized by thick arrows) and leaves it again after absorbing nebulized condensate through the second opening 20, which is arranged on the outgoing side of the heat sink 10 in respect of the process air flow. This allows a pressure loss in the process air flow occurring across the heat sink 10 to be utilized to form a subflow, which is not cooled in the heat sink 10 and can thus absorb the condensate better than cooled air. Also associated with the collecting vessel 18 is a fill level sensor 21. This is used to ascertain any excess of condensate present and indicate this to a user so that said user can act accordingly, for example otherwise disposing of the excess of condensate.

Even though the exemplary embodiments of the invention show exhaust air dryers, it should be noted that the invention is not restricted to exhaust air dryers but in particular also covers laundry dryers which circulate the process air anyway to some degree. In any case an inventive laundry dryer allows partial recovery of thermal energy, which would otherwise be lost to the drying process, without an occurrence of condensate, which would have to be disposed of separately in a particular manner. The invention is therefore also attractive from an economic standpoint for use in particular but not exclusively in an exhaust air dryer.

The invention claimed is:

1. A laundry dryer comprising:
- a drying chamber;
- a process air channel with
  - a supply air opening for drawing in process air,
  - an exhaust air opening for expelling process air,
  - an exhaust air channel through which process air is conducted from the drying chamber to the exhaust air opening, and
  - a nebulizer that distributes condensate into the process air in the exhaust air channel;
- a fan in the process air channel for driving process air through the drying chamber; and
- a heat exchanger that extracts heat from process air flowing out from the drying chamber, supplies heat to process air flowing into the drying chamber, and separates the condensate from the process air for routing to the nebulizer.

2. The laundry dryer of claim 1, wherein the nebulizer comprises an ultrasonic nebulizer.

3. The laundry dryer of claim 1, wherein the heat exchanger has a heat sink and a heat source of a heat pump circuit.

4. The laundry dryer of claim 3, wherein the heat pump circuit comprises an inherently closed line system for circulating a cooling agent, the line system includes the heat sink as an evaporator for the cooling agent, a compressor for compressing the evaporated cooling agent, the heat source as a condenser for the compressed cooling agent and a throttle valve for decompressing the condensed cooling agent.

5. The laundry dryer of claim 1, wherein the exhaust air channel stores the condensate.

6. The laundry dryer as claimed in claim 5, wherein the exhaust air channel comprises a collecting vessel for collecting the condensate.

7. The laundry dryer of claim 6, wherein the collecting vessel includes a depression in the exhaust air channel.

8. The laundry dryer of claim 7, wherein the exhaust air channel has a wall region angled to the depression.

9. The laundry dryer of claim 6, wherein the collecting vessel is below the heat exchanger.

10. The laundry dryer of claim 9, wherein the collecting vessel comprises:
- a first opening on an incoming side relative to the process air flow to the exhaust air channel; and
- a second opening on an outgoing side relative to the process air flow to the exhaust air channel and that bridges the heat exchanger at least partially in the exhaust air channel.

11. The laundry dryer of claim 6, further comprising a fill level sensor associated with the collecting vessel.

12. The laundry dryer of claim 1, wherein the process air channel is an open channel leading from the supply air opening to the exhaust air opening.

13. The laundry dryer of claim 1, wherein the process air channel has a heater.

14. A method for operating a laundry dryer comprising:

driving process air with a fan through a process air channel and a drying chamber;

extracting heat from process air flowing from the drying chamber with a heat exchanger;

supplying heat to the process air flowing into the drying chamber with the heat exchanger;

drawing process air into a supply air opening;

expelling process air from an exhaust air opening, the exhaust air opening opening into an environment of the laundry dryer that is external to the laundry dryer;

conducting process air exiting from the drying chamber through an exhaust air channel to the exhaust air opening;

separating a condensate from the process air with a heat exchanger; and nebulizing the condensate into process air flowing through the exhaust air channel.

15. The method of claim 14, wherein the nebulizing uses ultrasound.

16. The method of claim 14, wherein the extracting heat and the supplying heat is by a heat pump in the heat exchanger.

17. The method of claim 14, wherein the conducting comprises conducting the process air through the exhaust air channel from the drying chamber to the exhaust air opening.

18. The method of claim 17, wherein the nebulizing distributes condensate into the process air in the exhaust air channel.

19. The method of claim 18, wherein the condensate is routed to a nebulizer for the nebulizing.

20. The method of claim 19, wherein the condensate is stored in the exhaust air channel prior to the nebulizing.

21. The laundry dryer of claim 1, wherein the exhaust air opening opens into an environment of the laundry dryer that is external to the laundry dryer.

* * * * *

UNITED STATES PATENT AND TRADEMARK OFFICE

CERTIFICATE OF CORRECTION

PATENT NO. : 8,578,626 B2
APPLICATION NO. : 12/677122
DATED : November 12, 2013
INVENTOR(S) : Günter Steffens It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 770 days.

Signed and Sealed this
Twenty-second Day of September, 2015

Michelle K. Lee

Michelle K. Lee
*Director of the United States Patent and Trademark Office*